US010519675B2

(12) United States Patent
Bonilla Nieto

(10) Patent No.: US 10,519,675 B2
(45) Date of Patent: Dec. 31, 2019

(54) MODULAR INTERMEDIATE DECK FOR MICRO HOUSING

(71) Applicant: ALDEA PROYECTOS S.A.S., Bogota (CO)

(72) Inventor: Julian Bonilla Nieto, Bogota (CO)

(73) Assignee: ALDEA PROYECTOS S.A.S., Bogota (CO)

( * ) Notice: Subject to any disclaimer, the term of this patent is extended or adjusted under 35 U.S.C. 154(b) by 0 days.

(21) Appl. No.: 16/190,240

(22) Filed: Nov. 14, 2018

(65) Prior Publication Data

US 2019/0177985 A1 Jun. 13, 2019

(30) Foreign Application Priority Data

Sep. 15, 2017 (CO) ..... NC2017/0009427

(51) Int. Cl.

| | |
|---|---|
| ***E04F 15/024*** | (2006.01) |
| ***E04F 11/02*** | (2006.01) |
| ***E04F 15/02*** | (2006.01) |
| ***E04C 2/08*** | (2006.01) |

(52) U.S. Cl.

CPC ..... *E04F 15/02405* (2013.01); *E04C 2/08* (2013.01); *E04F 11/02* (2013.01); *E04F 15/02161* (2013.01)

(58) Field of Classification Search

CPC ..... E04F 15/02405; E04F 15/02161; E04F 11/02; E04C 2/08

See application file for complete search history.

(56) References Cited

U.S. PATENT DOCUMENTS

| | | | | |
|---|---|---|---|---|
| 1,666,222 | A * | 4/1928 | Smith | E04B 1/08 52/272 |
| 3,236,018 | A * | 2/1966 | Graham | B62D 25/20 52/791.1 |
| 3,555,762 | A * | 1/1971 | Costanzo, Jr. | E04C 2/08 52/588.1 |
| 4,411,121 | A * | 10/1983 | Blacklin | E04C 2/326 52/630 |
| 8,793,948 | B2 * | 8/2014 | Beattie | E04B 1/26 52/267 |
| 2010/0180518 | A1 * | 7/2010 | Postlethwaite | E04H 1/005 52/79.1 |
| 2012/0079776 | A1 * | 4/2012 | Beattie | E04B 1/26 52/90.1 |
| 2018/0371761 | A1 * | 12/2018 | Green | E04F 11/00 |

* cited by examiner

*Primary Examiner* — Rodney Mintz

(74) *Attorney, Agent, or Firm* — Hoglund & Pamias, PSC; Roberto J. Rios

(57) ABSTRACT

The invention provides a composite and modular intermediate deck, designed to divide a micro home into an upper living volume and a lower living volume below the intermediate deck. The intermediate deck is characterized by having a U-shaped slot comprising from 10% to 60% of the total surface of the platform, which allows maximizing usage of vertical space by making the U-shaped slot, which serves as a corridor in the upper living volume, coincide with non-crossable spaces in the lower living volume. The height of crossable areas of the upper living volume is given by the distance from the floor to the flat surface of the intermediate deck. A micro home unit characterized by featuring the abovementioned deck is also provided.

17 Claims, 13 Drawing Sheets

MODULAR INTERMEDIATE DECK FOR MICRO HOUSING

FIELD OF INVENTION

This application relates to a composite and modular intermediate deck, designed to divide a tiny home into an upper living volume and a lower living volume below such intermediate deck. The intermediate deck is characterized by featuring a U-shaped slot comprising from 10% to 60% of the total surface of said platform, which allows maximizing usage of vertical space by making coincide said U-shaped slot, which serves as a corridor in the upper living volume, with non-crossable spaces in the lower living volume, while the height of crossable areas of the upper living volume is given by the distance from the floor to the flat surface of the intermediate deck, which is greater than 1.80 m. Likewise, it is a part of this invention the tiny home unit characterized by featuring the abovementioned deck.

STATE OF THE ART

At present cities tend to grow in size and such growth increases population density, cost of land and consequently that of housing.

Among the existing alternatives to make better use of the land, there has been a trend towards building smaller houses, mini-houses and micro-houses, "tiny homes" in English, whereby a large number or people seek a small space to live in. Even, the premise of some companies engaged in building this type of dwellings is that a smaller space leads to more freedom and peace of mind, while reducing the costs associated to the use of energy and natural resources, such as: electric power, water and gas.

This trend has become an architectural and social movement that endeavors living in a simple manner in small houses. At present there is no certainty as to what a mini-house or tiny home is considered, but it is agreed that a small house is below 93 m2 and a mini-house or tiny home is less than 46 m2.

In addition to the trend mentioned in the preceding paragraph, governments from different countries are looking on a daily basis for solutions to the housing deficit and provision of an adequate roof to everyone. The Colombian government is one of such governments and it has advanced programs intended to offer a roof to the residents of the neediest areas and especially the population displaced by violence, victims of natural disasters, public calamities or emergencies, residents of non-mitigable high risk zones, disabled, older adults and mothers being heads of households.

These events have driven the search of new dwelling options, where the required area is as small as possible, building costs are low, construction time is minimal and the achieved design allows residents to enjoy a comfortable environment where each dweller may enjoy their own space at a given time.

Among the elements that have been developed to fulfill at least some of the aforementioned requirements are those of creating metal floors, which have been designed to be sufficiently sturdy to handle constant traffic but which are economic and comfortable for users. This is the case of U.S. Pat. No. 3,555,762, which relates to metal modular floors, used as false flooring on vehicles, such as trucks or in small business buildings. Even though this application represents a step towards the construction of false flooring or floors for handling heavy traffic, the false floor proposed in this application is a flat surface, which could only be used in a remote case as an intermediate deck in a prefabricated house.

A similar type of floor is disclosed in U.S. Pat. No. 3,236,018, which refers to a rigid metallic floor panel built to be supported in a horizontal operative position at the edges or corners and the heavy load is held without appreciable deflection. Said panel comprises a pair of metal sheets arranged in a superimposed vertically spaced relationship, the upper sheet is rigid and imperforate to resist compression, while the lower sheet features a checkerboard grid comprising a set of parallel, straight strips extending longitudinally from edge to edge of said sheet and a second set of parallel, straight strips extending transversally from edge to edge of said sheet. As in the preceding application, this invention is intended for construction of flat floors or decks, which do not allow varying the height of the living volume above the intermediate deck of the housing unit.

Likewise, there is U.S. Pat. No. 4,411,121, which features a composite and flat floor panel having a pattern of dome-like projections, extending from said sheet. Once again the state of the art only discloses flat metal sheets.

In order to reach these goals, the applicant has used the teachings of the mini or micro-house movement and has applied his teachings to develop a housing unit destined to be part of apartment buildings that only require foundations, columns, exterior walls and a given space to insert the housing unit of this invention.

Supplementing these teachings, the applicant has developed an intermediate deck, which is made out of metal, just as floors of cars, truck, airplanes or ships are manufactured, which guarantees a reduction in the production cost, without there being any deflection and allowing vertical optimization of the space insofar as said intermediate deck serves as a floor on the space above the platform, thus allowing generation of a housing unit having a living volume below the deck a and a living volume above said deck, where used is made of no traffic spaces in the lower living volume to make the same coincide with the corridor of the upper living volume and traffic areas of the lower living volume are located in no traffic areas of the upper living volume, such as the place where beds are located.

DETAILED DESCRIPTION OF THE INVENTION

Figure 1:
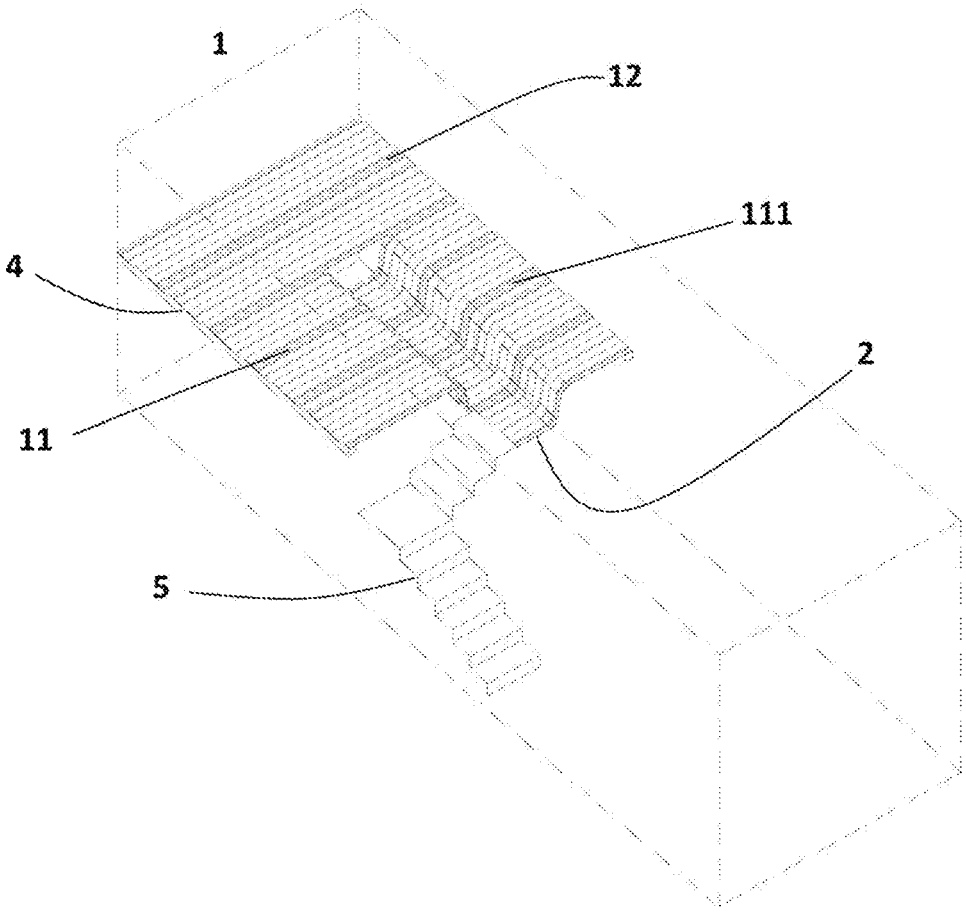
FIG. 1. Shows an embodiment of the intermediate deck (1) and the elements comprising the upper living volume of the housing unit of this invention along with the staircase (5).

The present invention relates to a composite and modular intermediate deck (1), made out of metal by means of industrial processes used in vehicle productions lines, whereby vehicles structures and floors are produced and also used in manufacturing parts for airplanes and ships, designed to divide the volume of a tiny home into a lower living volume and an upper living volume with respect to said intermediate deck (1). The intermediate deck (1) is characterized by having corridor modules (11) with a U-shaped slot (2) comprising the corridor or hall of the upper living volume and flat surfaced straight modules (12), wherein the aggregate area of the U-shaped slots (2), that is, the corridor or hall, comprises from to 10% to 60% of the total surface area of said intermediate deck (1), preferably from 10% to 40% of the total surface area of said intermediate deck (1), and the height of the U-shaped slot (2) ranges from 30 cm to 60 cm.

Figure 2A:
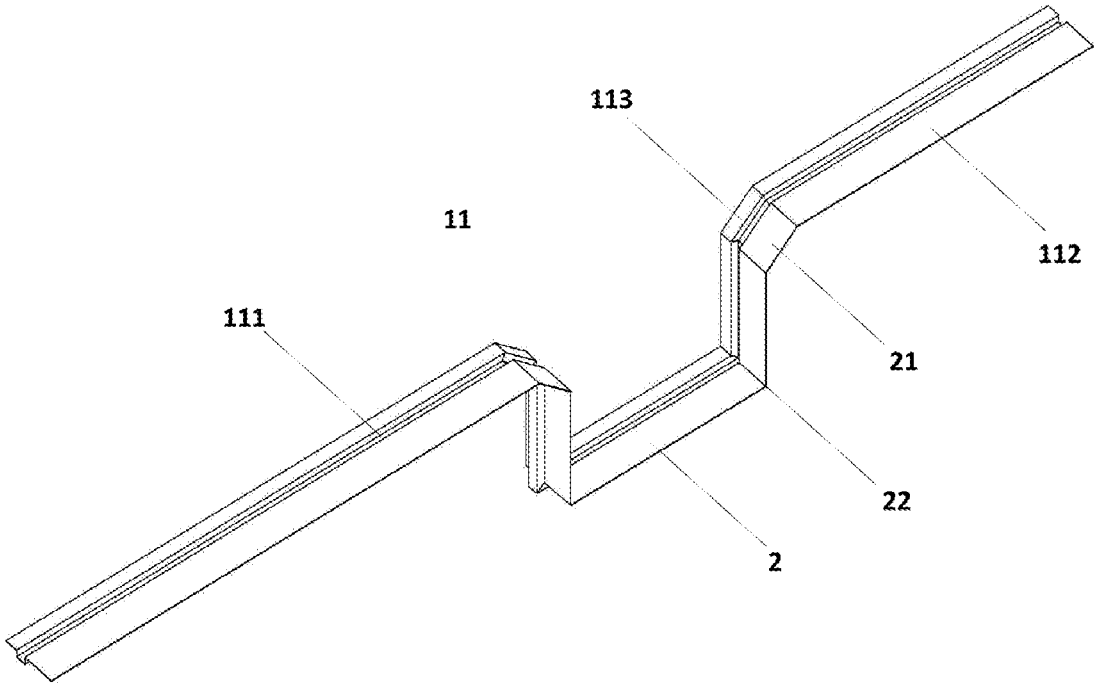
FIG. 2A. A perspective of the corridor module (11) of the intermediate deck (1) with a U-shaped slot (2) whose upper edge (21) is cut by means of a diagonal plane and the lower edge (22) forms a right angle.
Figure 2B:
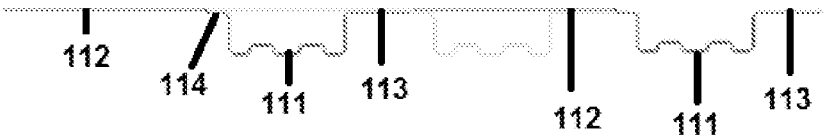
FIG. 2B. Shows a cross-section of the corridor module (11) of the intermediate deck (1).
Figure 3A:
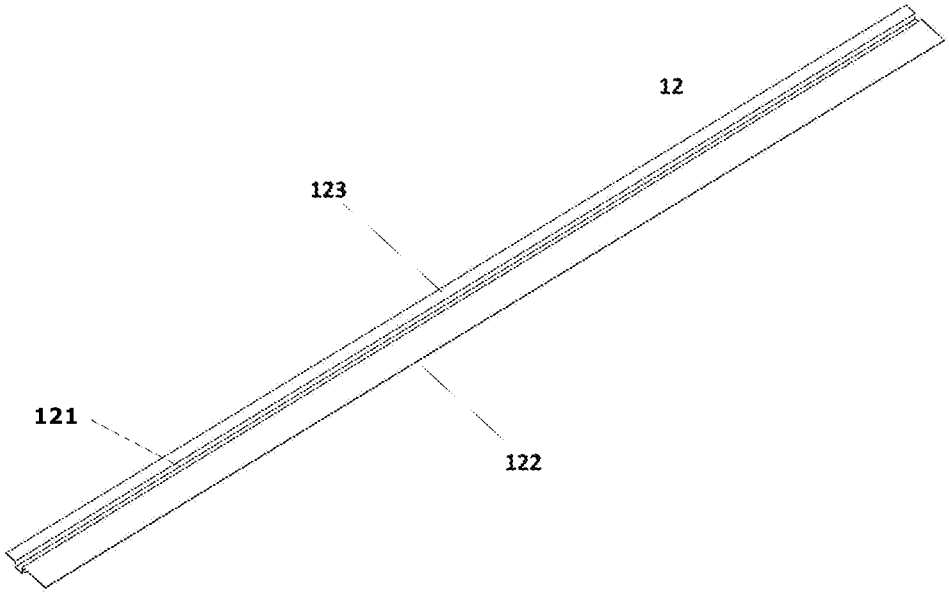
FIG. 3A. A perspective of the straight module (12) of the intermediate deck (1) with three differentiated areas (121, 122 and 123).
Figure 3B:
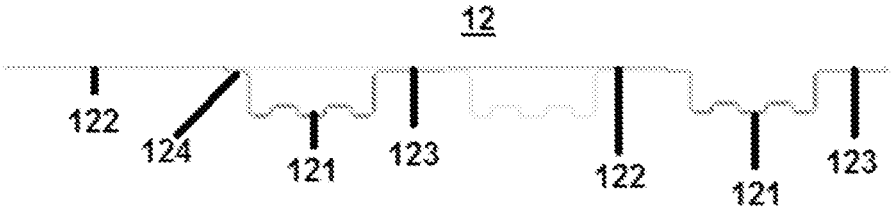
FIG. 3B. Shows a cross-section of the straight module (12) of the intermediate deck (1) with three differentiated areas (121, 122 and 123).

In a preferred embodiment of the invention, the corridor modules (11) and the straight modules (12) longitudinally comprise a composite and grooved strip (111, 121) surrounded by two flat strips (112, 113 or 122, 123), wherein the width of the flat strips (112, 122) is from 10% to 100% wider than the width of the second strip (113, 123), the height of the wider strip (112, 122) with respect to the composite strip base (111,121) 3 mm to 10 mm higher than the narrower strip (113, 123) with respect to the composite strip (111, 121) and the joint between the wider strip (112, 122) and the composite strip (111, 121) features a notch (114, 124). The above is so that upon overlaying a module (11,12) over another module, regardless of whether such second module is a corridor module (11) or a straight module (12), making the wider strip (112, 122) of the second module (11, 12) cover the composite strip (111, 121) of the first module and fit into the notch (114, 124) of said first module. The elements constituting each module may be seen in FIGS. 2A and 3A, while the manner in which said modules are overlaid is depicted in FIGS. 2B and 3B.

In addition, the U-shaped slot (2) features an upper edge (21) that joins the flat surfaces of the intermediate deck (1) and a lower edge or lower radius zone of the hall (22).

Figure 5:
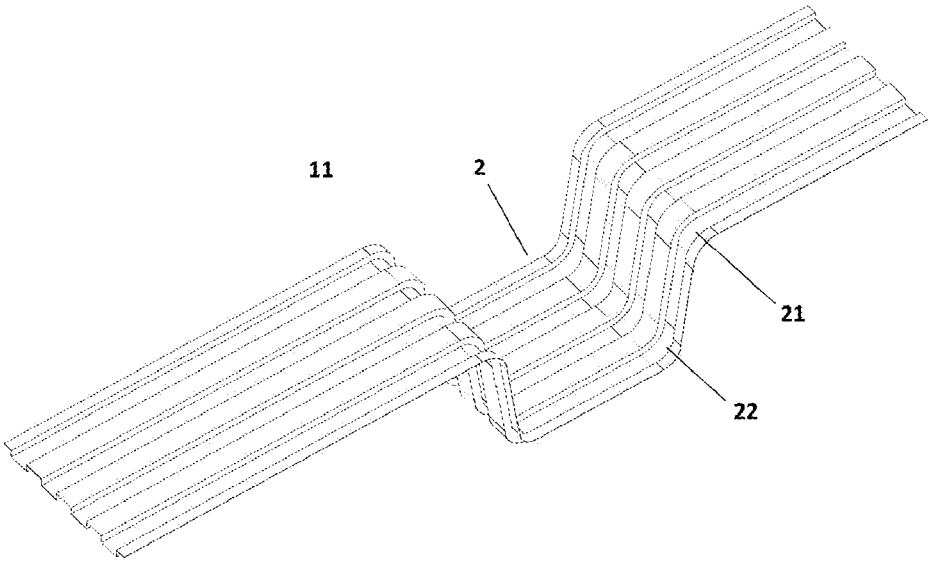
FIG. 5. Depicts an alternative corridor module (11) of the intermediate deck (1) wherein the upper edge (21) and the lower edge (22) are curved.
Figure 6:
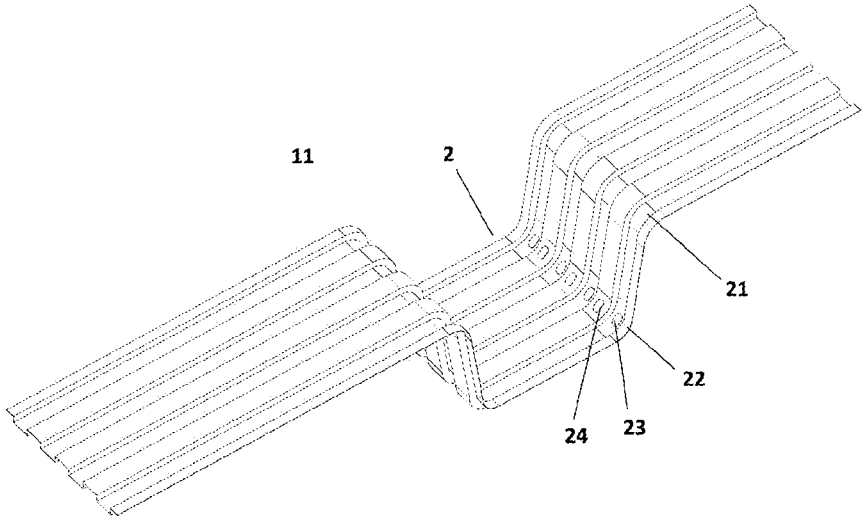
FIG. 6. Depicts an alternative corridor module (11) of the intermediate deck (1) wherein the upper edge (21) and the lower edge (22) are curved but the lower edge features smoothed reinforcements of different length wherein longer reinforcements (23) are interspaced with shorter reinforcements (24).

In an embodiment of the invention, the upper edge (21) and the lower edge (22) of the U-shaped slot are curved, as shown in FIG. 5. In another alternative, the lower edge (22) of the U-shaped slot is curved and features smoothed reinforcements (23, 24), the size of which varies depending on the design of the longitudinal strips of the module (11), as shown in FIG. 6.

Figure 4:
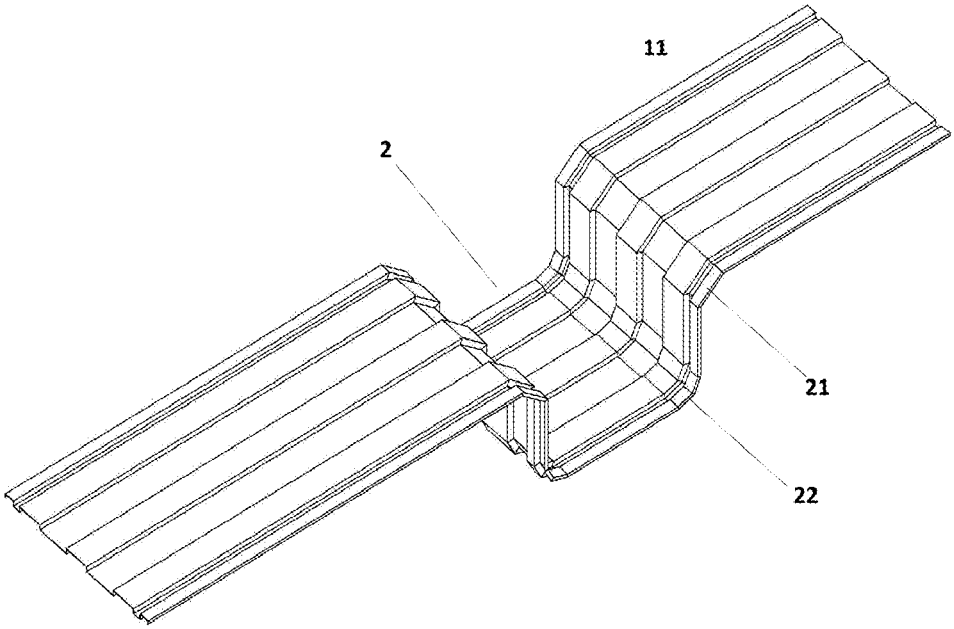
FIG. 4. Shows an alternative of the corridor module (11) of the intermediate deck (1) wherein the upper edge (21) and the lower edge (22) are cut by diagonal planes.

In a different embodiment, the upper end (21) and the lower end (22) are cut forming a diagonal plane as shown in FIG. 4.

Figure 7:
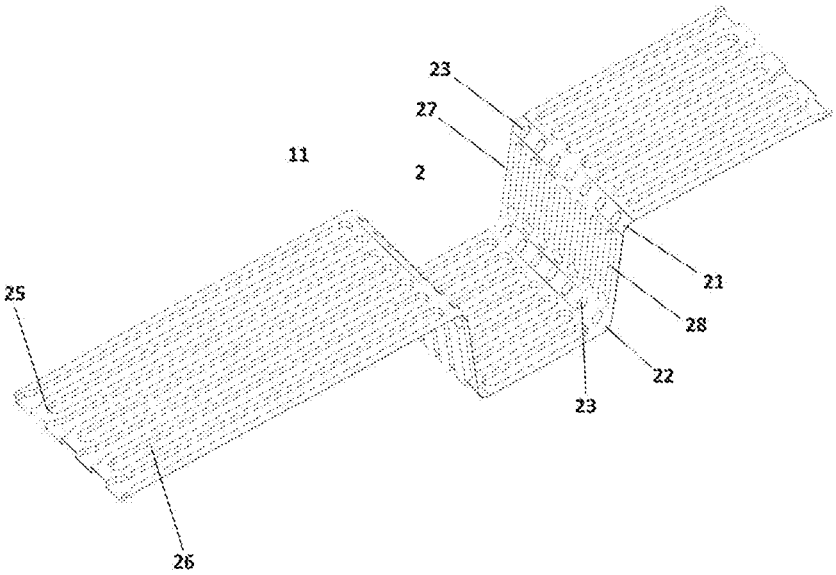
FIG. 7. Perspective of an alternative corridor module (11) of the intermediate deck (1) wherein the strips running along said module are interrupted before the upper edge (21) and the lower edge (22), which are curved and feature same length smoothed reinforcements.

In another option, the longitudinal strips of the module (11) are replaced by a design having elevated surfaces (25) with a central cutout (26), which is interrupted at the upper curved end (21), a raised surface (27) with oval-shaped cutouts (28) at the center is found on the side walls of the U shaped slot (2), which is interrupted again at the lower end (22) and features on the lower end of the U shaped slot the raised surface (27) design with oval-shaped cutouts (28). Finally, in this alternative of the invention, which is shown in FIG. 7, the upper end (21) and the lower end (22) feature discontinuous reinforcements (23).

Figure 8:
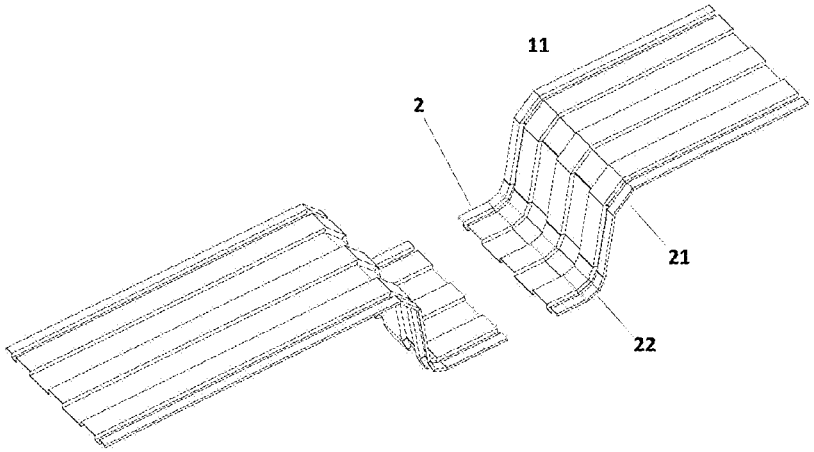
FIG. 8. Shows a depiction of the corridor module (11) and the blank module (13) separated at the middle by the U-shaped slot forming two halves of the corridor module (11) and the blank module (13) respectively.

In a preferred embodiment of the invention, the corridor module (11) and the blank module (13) are separated in the middle of the U-shaped slot (2), forming two halves of corridor module (11) and blank module (13), respectively, which allow stacking said halves in a single block for transportation purposes of the same. These halves of the corridor module (11) and blank module (13) can be joined again using means of attachment and mechanical or permanent coupling. FIG. 8 depicts this alternative of the invention.

In another embodiment of the invention, the lower edge (22) has an angle from 0° to 4° over the U-shaped slot (2) base so that the one module and another can be stacked during the logistical process of packaging and transportation.

Likewise, it is a part of the invention a housing unit or tiny home comprising the intermediate deck (1), a pair of tie beams (4) and featuring a staircase (5) communicating the upper living volume with the lower living volume.

Figure 9:
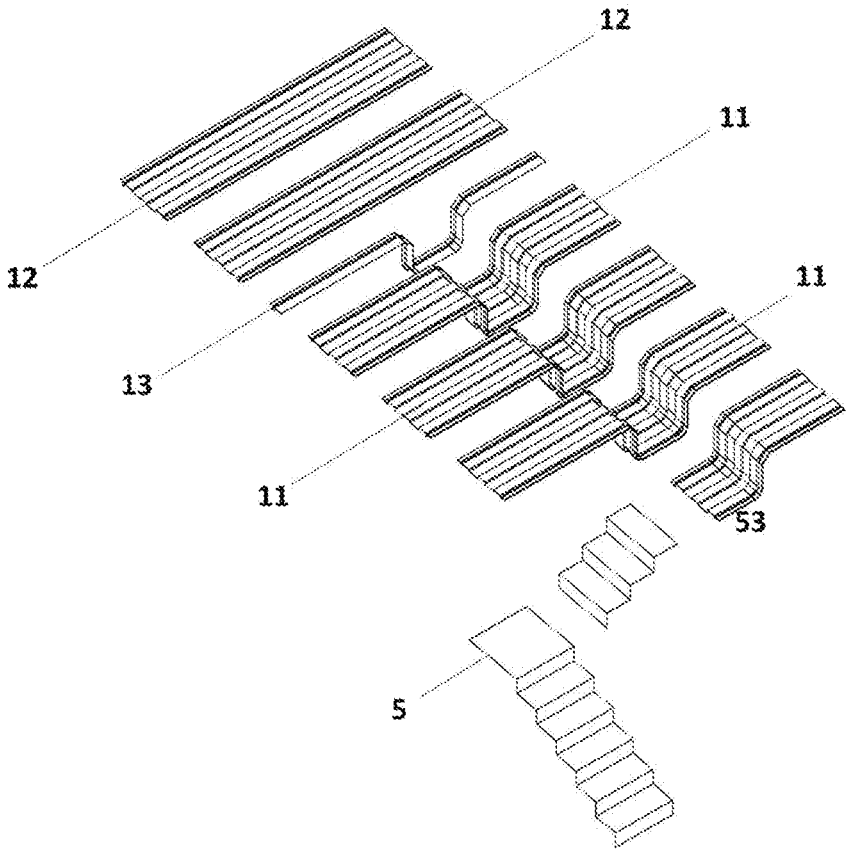
FIG. 9. Perspective of the different elements comprising the platform and the upper living volume of the housing unit of this invention.

The different design alternatives include among others combining 2 to 5 corridor modules (11) and from 1 to 5 flat surface straight modules (12). In an alternative of the invention, the unit also comprises a blank transversal module (13) and the staircase (5) includes a cantilever (53) as shown in FIG. 9.

EXAMPLES

Example 1. Forming Alternatives

Figure 10A:
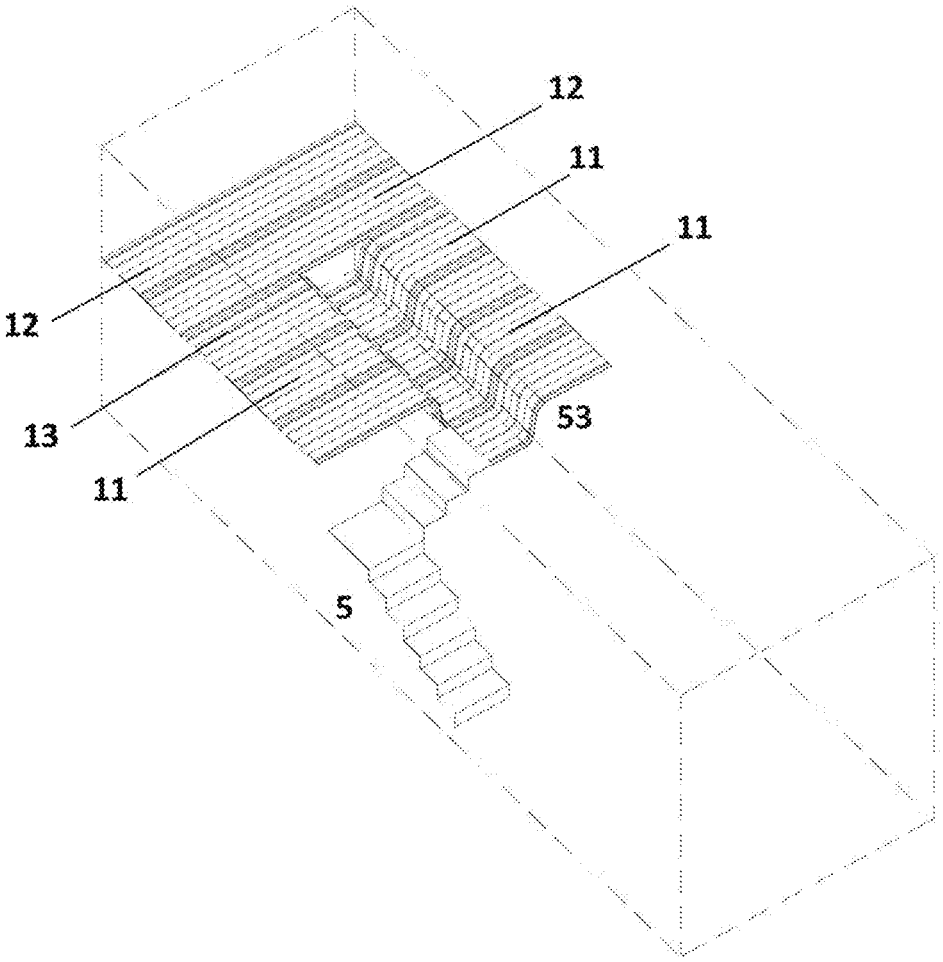
FIG. 10A. Depicts an alternative deck of this invention wherein the intermediate deck (1) is comprised of three corridor modules (11), two straight modules (12) and a blank module (13).

Some of the alternatives to form the intermediate deck (1) are shown in FIG. 10, wherein FIG. 10A relates to an intermediate deck (1) comprising 3 corridor modules (1), 2 flat surface straight modules (12) and a blank transversal module (13), thus allowing building a house whose upper living volume has a floor area of approximately 28.5 m2.

Figure 10B:
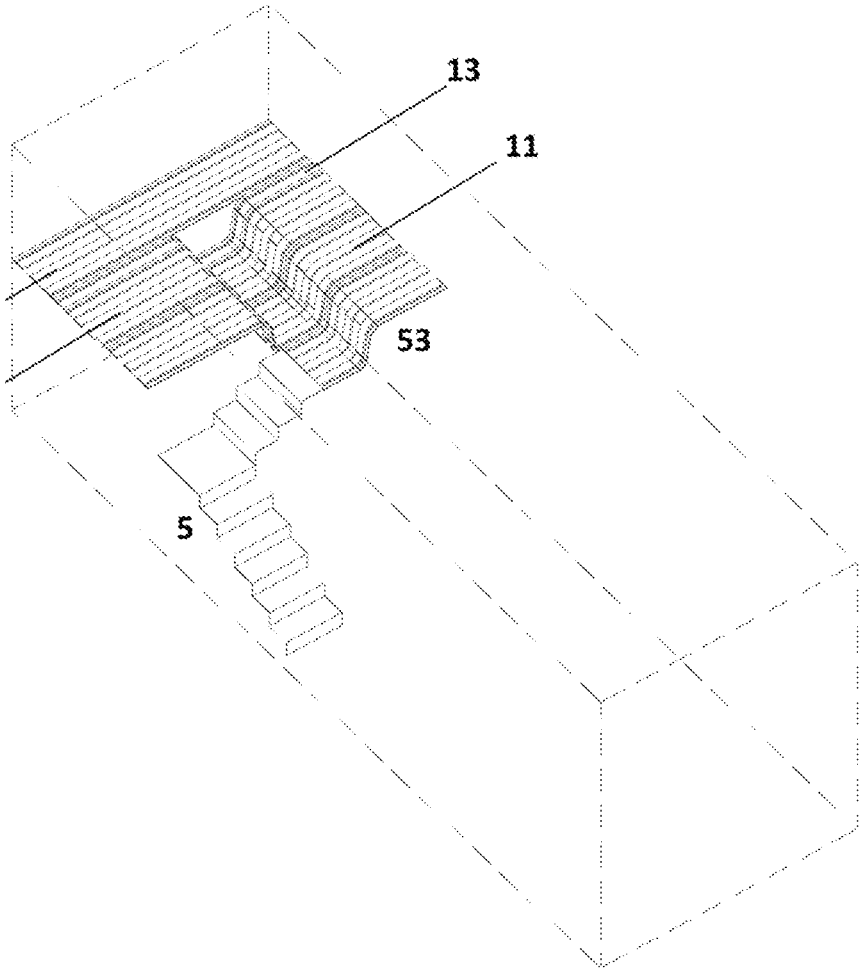
FIG. 10B. Depicts an alternative deck of this invention, wherein the intermediate deck (1) is comprised of two corridor modules (11) a straight module (12) and a blank module (13).

While FIG. 10B shows an intermediate deck (1) comprising 2 corridor modules (11), a flat surface straight module (12) and a blank transversal module (13), which allows building a house whose upper living volume has a floor area of approximately 22.5 m2.

Figure 10C:
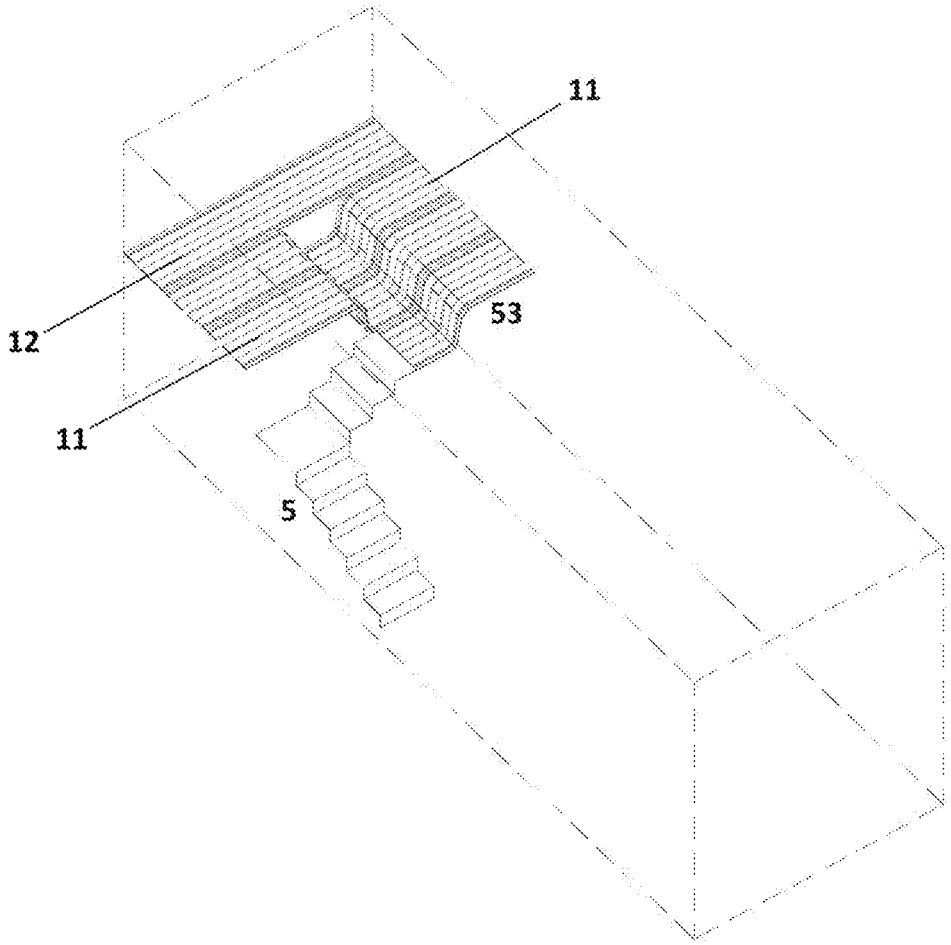
FIG. 10C. Depicts an alternative deck of this invention, wherein the intermediate deck (1) is comprised of two corridor modules (11) and a single straight module (12).
Figure 11:
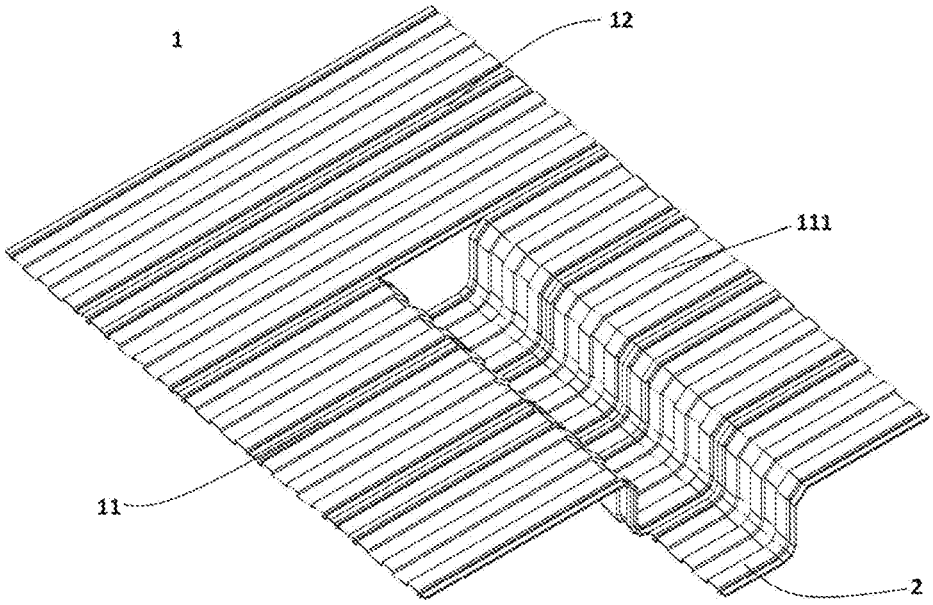
FIG. 11. Shows an illustration of the intermediate deck (1) and the elements comprising the upper living volume of the housing unit of this invention.

Finally, FIG. 10C relates to an intermediate deck (1) comprising 2 corridor modules (11) and a flat surface straight module (12) without the presence of any blank transversal module (13). This arrangement allows obtaining a floor area of 21 m2 for the upper living volume.

The invention claimed is:

1. A metal composite and modular intermediate deck (1), configured to divide a house into a lower living volume below said deck and an upper living volume above said deck, said deck (1) comprising:

corridor modules (11) having a U-shaped slot (2) defining a corridor or hall of the upper living volume, wherein the U-shaped slot (2) comprises an upper edge (21) that joins an upper surface of the corridor modules (11) to a side wall provided between said upper surface and a bottom surface of said U-shaped slot (2), and a lower edge (22) joining said side wall to said bottom surface of said U-shaped slot (2); and flat surface straight modules (12), wherein each of the corridor modules (11) and straight modules (12) longitudinally comprise a cutout and composite strip (111, 121) provided between two flat strips (112, 113 or 122, 123), wherein one of said corridor module (11) or said flat straight module (12) is overlaid over another of said corridor module (11) or said flat straight module (12) so that a wider said flat strip (112, 122) of the overlaid module covers the cutout and composite strip (111, 121) of the module positioned therebelow;

wherein a total area of the U-shaped slots (2) is from 10% to 60% of a total surface area of said intermediate deck (1) and a height of the U-shaped slot (2) ranges from 30 cm to 60 cm.

2. The metal composite and modular (1) intermediate deck (1) in accordance with claim 1, wherein the total area of the U-shaped slots (2) forming the corridor or hall, is from 10% to 40% of the total surface area of said intermediate deck (1).

3. The metal composite and modular intermediate deck (1) according to claim 1, wherein the upper edge (21) and the lower edge (22) have a diagonal surface with respect to the bottom surface of said U-shaped slot (2).

4. The metal composite and modular (1) intermediate deck (1) according to claim 1, wherein the upper surface of the corridor module (11) comprises upper elevated surfaces (25) having an upper cutout (26) within, said upper elevated surfaces (25) being interrupted at the upper edge (21); said side wall comprises side elevated surfaces (27) having a side cutout (26) within, said side elevated surfaces (27) being interrupted at the upper edge (21) and at the lower edge (22); and the bottom surface of said U-shaped slot (2) comprises bottom elevated surfaces (27) having a bottom cutout (26) within, wherein the upper edge (21) and lower edge (22) comprise discontinuous reinforcements (23).

5. The metal composite and modular intermediate deck (1) according to claim 1, wherein the upper edge (21) and the lower edge (22) of the U-shaped slots are curved zones.

6. The metal composite and modular intermediate deck (1) according to claim 5, wherein the lower edge (22) of the U-shaped slot comprises smoothed reinforcements (23, 24).

7. The metal composite and modular intermediate deck (1) according to claim 1, wherein the wider of the flat strips (112, 122) is 10% to 100% wider than the width of the other flat strip (113, 123), a height of the wider flat strip (112, 122) with respect to a base of said cutout and composite strip (111, 121) is 3 mm to 10 mm greater than a height of narrower strip (113, 123) with respect to the base of said cutout and composite strip (111, 121), wherein a notch is provided on a joining point between said wider flat strip (112, 122) and the cutout and composite strip (111, 121).

8. The metal composite and modular (1) intermediate deck (1) according to claim 7, wherein an end of said overlaid module fits into the notch of the module below said overlaid module.

9. A housing unit comprising the intermediate deck (1) according to claim 1, a pair of tie beams (4) and a staircase communicating the upper living volume with the lower living volume.

10. The housing unit according to claim 9, wherein the intermediate deck (1) comprises three said corridor modules (11), two said flat surface straight modules (12) and a blank transversal module (13) provided between a respective said corridor module (11) and respective said flat surface straight modules (12).

11. The housing unit according to claim 9, wherein the intermediate deck (1) comprises two said corridor modules (11), said flat surface straight module (12) and a blank transversal module (13) provided between a respective said corridor module (11) and respective said flat surface straight modules (12).

12. The housing unit according to claim 9, wherein the intermediate deck (1) does not have a blank transversal module (13) provided between a respective said corridor module (11) and respective said flat surface straight modules (12).

13. The housing unit according to claim 9, wherein the U-shaped slot (2) is provided at a middle of said corridor modules (11).

14. The housing unit according to claim 9, wherein the intermediate deck (1) comprises a combination from two to five said corridor modules (11) and one to five said flat surface straight modules (12).

15. The housing unit according to claim 14, wherein the intermediate deck (1) comprises the combination from two to three said corridor modules (11) and one to two said flat surface straight modules (12).

16. The housing unit according to claim 9, wherein the intermediate deck (1) further comprises a blank transversal module (13) having a U-shaped slot (2), said blank transversal module (13) being provided between a respective said corridor module (11) and respective said flat surface straight modules (12), said staircase (5) including an overhang (53).

17. The housing unit according to claim 16, wherein the U-shaped slot (2) of said corridor modules (11) and the U-shaped slot (2) of the blank transversal module (13) being provided at a middle of said corridor modules (11) and at a middle of said blank transversal module (13), respectively.

* * * * *